US011019843B2

(12) United States Patent
Uthurry

(10) Patent No.: US 11,019,843 B2
(45) Date of Patent: Jun. 1, 2021

(54) AEROSOL-GENERATING ARTICLE HAVING DISPERSED FLAVOURANT

(71) Applicant: PHILIP MORRIS PRODUCTS S.A., Neuchatel (CH)

(72) Inventor: Jerome Uthurry, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 158 days.

(21) Appl. No.: 15/760,657

(22) PCT Filed: Sep. 29, 2016

(86) PCT No.: PCT/EP2016/073265
§ 371 (c)(1),
(2) Date: Mar. 16, 2018

(87) PCT Pub. No.: WO2017/055456
PCT Pub. Date: Apr. 6, 2017

(65) Prior Publication Data

US 2019/0059442 A1 Feb. 28, 2019

(30) Foreign Application Priority Data

Sep. 30, 2015 (EP) ..... 15187781

(51) Int. Cl.
*A24D 3/06* (2006.01)
*A24D 3/02* (2006.01)
(Continued)

(52) U.S. Cl.
CPC ..... *A24D 3/061* (2013.01); *A24D 3/0216* (2013.01); *A24D 3/0229* (2013.01);
(Continued)

(58) Field of Classification Search
CPC ..... A24D 3/18; A24D 3/061; A24D 3/0216; A24D 3/0254; A24D 3/14; A24D 3/0229; A24D 47/00; A24D 47/002
See application file for complete search history.

(56) References Cited

U.S. PATENT DOCUMENTS 4,515,769 A 5/1985 Merritt
5,051,222 A 9/1991 Marten
(Continued)

FOREIGN PATENT DOCUMENTS

CN 101594792 12/2009
DE 102007043776 3/2009
(Continued)

OTHER PUBLICATIONS

Extended European Search Report for Application No. 15187781.8 dated Mar. 15, 2016 (8 pages).
(Continued)

*Primary Examiner* — Michael H. Wilson
*Assistant Examiner* — Dionne W. Mayes
(74) *Attorney, Agent, or Firm* — Mueting Raasch Group

(57) ABSTRACT

There is provided an aerosol-generating article (10) comprising an aerosol-generating substrate (12) and a mouthpiece (14). The mouthpiece (14) comprises at least one segment of filter material (18, 20, 22), a breakable capsule (26) containing an aqueous liquid (32), and a plurality of microencapsulated flavourant particles (38) dispersed within the at least one segment of filter material (22). Each of the microencapsulated flavourant particles (38) comprises a flavourant encapsulated within a shell comprising a water sensitive material, such that the plurality of microencapsulated flavourant particles (38) are adapted to release a flavourant upon contact with the liquid (32) contained within the breakable capsule (26).

16 Claims, 1 Drawing Sheet

(51) Int. Cl.
*A24D 3/14* (2006.01)
*A24D 3/18* (2006.01)

(52) U.S. Cl.
CPC ..... *A24D 3/0254* (2013.01); *A24D 3/14* (2013.01); *A24D 3/18* (2013.01)

(56) References Cited

U.S. PATENT DOCUMENTS

| | | | | |
|---|---|---|---|---|
| 6,631,722 | B2 | 10/2003 | MacAdam | |
| 7,878,962 | B2 | 2/2011 | Karles | |
| 8,739,802 | B2 | 6/2014 | Fagg | |
| 2003/0198652 | A1 | 10/2003 | Shefer | |
| 2005/0000531 | A1 | 1/2005 | Shi | |
| 2008/0216850 | A1 | 9/2008 | Braunshteyn | |
| 2011/0036367 | A1 | 2/2011 | Saito | |
| 2011/0271968 | A1 | 11/2011 | Carpenter | |
| 2012/0080044 | A1 | 4/2012 | Yanchev | |
| 2013/0047999 | A1* | 2/2013 | Rushforth | A24D 3/061 131/332 |
| 2013/0220349 | A1 | 8/2013 | Robertson | |
| 2015/0027458 | A1 | 1/2015 | Grant | |
| 2015/0027468 | A1 | 1/2015 | Li | |
| 2016/0295914 | A1* | 10/2016 | Jordil et al. | A24D 3/163 |
| 2017/0064995 | A1* | 3/2017 | Beeson | A24D 1/02 |

FOREIGN PATENT DOCUMENTS

| | | |
|---|---|---|
| EP | 2982254 | 2/2016 |
| JP | 2003-304856 | 4/1995 |
| JP | 2008-539717 | 11/2006 |
| JP | 2010-505423 | 2/2010 |
| JP | 2013-514802 | 6/2011 |
| JP | 2013-526266 | 11/2011 |
| JP | 2015-507940 | 8/2013 |
| WO | WO 2009/036851 | 3/2009 |
| WO | WO 2009-157240 | 12/2009 |
| WO | WO 2012/156692 | 11/2012 |
| WO | WO 2012/156694 | 11/2012 |
| WO | WO 2012/156695 | 11/2012 |
| WO | WO 2014/196369 | 12/2014 |

OTHER PUBLICATIONS

PCT Search Report and Written Opinion for PCT/EP2016/073265 dated Dec. 23, 2016 (11 pages).
Office Action issued in China for Application No. 201680053458.0 dated Apr. 30, 2020 (19 pages).
Office Action issued in Indonesia for Application No. PID201801854 dated May 12, 2020 (4 pages). English translation included.
Office Action issued in Japan for Application No. 443853 dated Oct. 29, 2020 (7 pages). English translation included.

* cited by examiner

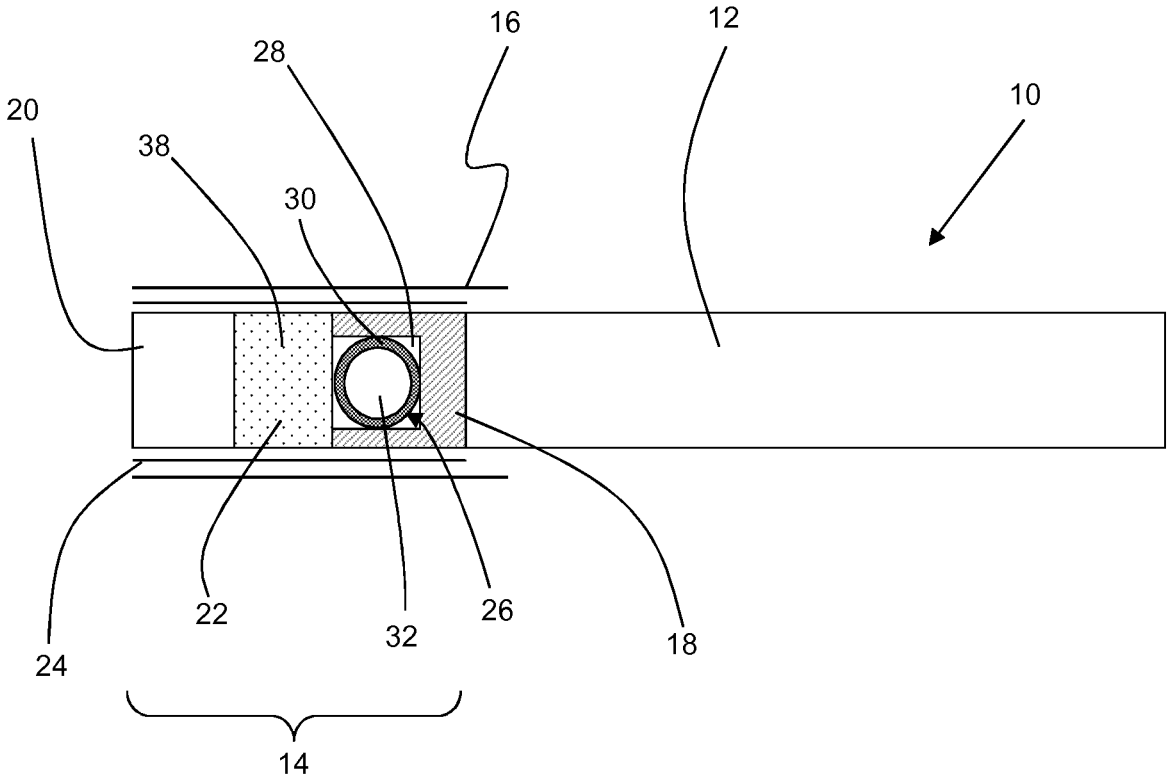
16
12
28
10
20
38
30
22
32
26
18
24
14

AEROSOL-GENERATING ARTICLE HAVING DISPERSED FLAVOURANT

This application is a U.S. National Stage Application of International Application No. PCT/EP2016/073265, filed Sep. 29, 2016, which was published in English on Apr. 6, 2017, as International Publication No. WO 2017/055456 A1. International Application No. PCT/EP2016/073265 claims priority to European Application No. 15187781.8 filed Sep. 30, 2015.

The present invention relates to an aerosol-generating article having a flavourant dispersed within a filter material, and a method for making filter rods comprising a flavourant dispersed within a filter material. Aerosol-generating articles according to the present invention find particular application as elongate smoking articles, such as cigarettes.

Filter cigarettes typically comprise a cylindrical rod of tobacco cut filler surrounded by a paper wrapper and a cylindrical filter axially aligned in an abutting end-to-end relationship with the wrapped tobacco rod. The cylindrical filter typically comprises a filtration material circumscribed by a paper plug wrap. Conventionally, the wrapped tobacco rod and the filter are joined by a band of tipping wrapper that normally circumscribes the entire length of the filter and an adjacent portion of the wrapped tobacco rod. A conventional filter cigarette is typically smoked by lighting the end of the cigarette opposite the mouthpiece so that the tobacco rod burns.

A number of aerosol generating articles in which tobacco is heated rather than combusted have also been proposed in the art. In heated aerosol generating articles, an aerosol is generated by heating a flavour generating substrate, such as tobacco. Known heated aerosol generating articles include, for example, electrically heated aerosol generating articles and aerosol generating articles in which an aerosol is generated by the transfer of heat from a combustible fuel element or heat source to a physically separate aerosol forming material. During smoking, volatile compounds are released from the aerosol forming substrate by heat transfer from the fuel element and entrained in air drawn through the aerosol generating article. As the released compounds cool they condense to form an aerosol that is inhaled by the consumer. Also known are aerosol generating articles in which a nicotine-containing aerosol is generated from a tobacco material, tobacco extract, or other nicotine source, without combustion, and in some cases without heating, for example through a chemical reaction.

Some aerosol generating articles comprise a flavourant that is delivered to the consumer during use of the aerosol generating article. For example, some filter cigarettes incorporate a flavourant into the filter material so that the flavourant is entrained within the mainstream smoke when the consumer draws on the cigarette. However, such cigarettes do not provide the consumer with any control over when the flavourant is delivered.

It would be desirable to provide an aerosol generating article that provides a novel method of delivering a flavourant to a consumer. It would be particularly desirable for such an aerosol generating article to provide the consumer with control over when the flavourant is delivered.

According to a first aspect of the present invention there is provided an aerosol-generating article comprising an aerosol-generating substrate and a mouthpiece. The mouthpiece comprises at least one segment of filter material, a breakable capsule containing a liquid, and a plurality of microencapsulated flavourant particles dispersed within the at least one segment of filter material. The plurality of microencapsulated flavourant particles are adapted to release a flavourant upon contact with the liquid contained within the breakable capsule.

As used herein, the term "aerosol generating substrate" is used to describe a substrate capable of releasing, upon heating (including combustion), volatile compounds, which can form an aerosol. The aerosol generated from aerosol generating substrates may be visible or invisible and may include vapours (for example, fine particles of substances, which are in a gaseous state, that are ordinarily liquid or solid at room temperature) as well as gases and liquid droplets of condensed vapours.

As used herein, the term "flavourant" is used to describe a material that can be used to deliver at least one of a gustatory sensation and an olfactory sensation to a consumer.

A flavourant may comprise a material intended to deliver a gustatory sensation upon oral ingestion by the consumer. The gustatory sensation may comprise at least one of a taste sensation, a cooling or a warming sensation, a tingling sensation, a numbing sensation, effervescence, increased salivation, and combinations thereof.

Alternatively, a flavourant may comprise a material intended to deliver an olfactory sensation without oral ingestion by the consumer. Such flavourants may comprise at least one volatile compound that delivers an olfactory sensation at room temperature or upon heating.

Additionally, or alternatively, the flavourant may comprise one or more compounds intended to function as a deodorising agent to mask or remove odours, for example odours generated during smoking of the aerosol generating article.

As used herein, the term "microencapsulated flavourant particle" describes a small, discrete particle having a structure in which the flavourant is encapsulated within a shell such that the flavourant remains sealed and trapped within the shell until the shell material is ruptured or broken down during use. The microencapsulated flavourant particle may be of a reservoir type, comprising an inner core of the flavourant contained within an outer shell. Alternatively, the microencapsulated flavourant particle may be of a matrix type, in which the flavourant material is dispersed within a shell matrix, such that a plurality of droplets of the flavourant material are trapped within the shell material.

By providing a plurality of microencapsulated flavourant particles that release a flavourant upon contact with the liquid in a breakable capsule, aerosol generating articles according to the present invention advantageously provide a consumer with control over when the flavourant is delivered. For example, the consumer can choose to break the breakable capsule before, during or after smoking the aerosol generating article. Upon breaking the breakable capsule the liquid is released from the breakable capsule, which causes release of the flavourant upon contact between the liquid and the microencapsulated flavourant particles.

A consumer may choose to break the breakable capsule before smoking to provide a flavoured smoking experience, or the consumer may choose to break the breakable capsule after smoking to provide an unflavoured smoking experience and a post-smoking delivery of flavourant.

Alternatively, the consumer can choose to not break the breakable capsule at all to provide an entirely unflavoured experience.

By providing the flavourant in a plurality of microencapsulated flavourant particles, aerosol generating articles according to the present invention can also advantageously minimise loss of the flavourant from the aerosol generating article during storage. This is particularly advantageous in those embodiments in which the flavourant comprises one or more volatile compounds.

As an aerosol (such as smoke) is generated in an aerosol-generating article, the temperature of the aerosol decreases as it travels along a path towards the mouth end of the article, passing the breakable capsule as well as the microencapsulated flavourant particles in the mouthpiece. The microencapsulated flavourant particles are thermally stable at the temperature of the aerosol as the aerosol contacts the particles in the mouthpiece. That is, the microencapsulated flavourant particles do not release the flavourant due to exposure to the temperature of the aerosol contacting the particles.

The temperature of the aerosol as it contacts the particles depends in part on the position of the particles in the mouthpiece relative to the source of the aerosol that is generated in the aerosol generating article. Preferably, the microencapsulated flavourant particles are thermally stable at temperatures up to about 70 degrees Celsius, preferably up to about 80 degrees Celsius, more preferably up to about 90 degrees Celsius.

Each of the microencapsulated flavourant particles may comprise the flavourant contained within a shell comprising a hydrophilic material, preferably a water-sensitive material, and wherein the liquid contained within the breakable capsule comprises water. In such embodiments, the microencapsulated flavourant particles will release the flavourant upon contact of the hydrophilic shell with water or water vapour. Preferably, the flavourant contained within the shell is hydrophobic relative to the water-sensitive or hydrophilic material in the shell.

Water-sensitive materials suitable for forming the shell of each microencapsulated flavourant particle include water soluble and water dispersible polymers and copolymers, starch derivatives, polysaccharides, hydrocolloids, natural gums, proteins, and mixtures thereof.

In those embodiments in which each microencapsulated flavourant particle comprises a flavourant contained within a shell, the shell of each microencapsulated flavourant particle may comprise at least one of polyvinyl alcohol, gelatin, one or more carrageenans, agar, gellan gum, one or more pectins, arabic gum, ghatti gum, pullulan gum, mannan gum, one or more modified starches, one or more alginate salts, hydrolyzed polyvinyl acetate about 75 percent to 90 percent hydrolyzed, hydroxyalkyl celluloses, carboxyalkyl celluloses, and combinations thereof.

Examples of water soluble hydroxyalkyl and carboxyalkyl celluloses include hydroxyethyl and carboxymethyl cellulose, hydroxyethyl and carboxyethyl cellulose, hydroxymethyl and carboxymethyl cellulose, hydroxypropyl carboxymethyl cellulose, hydroxypropyl methyl carboxyethyl cellulose, hydroxypropyl carboxypropyl cellulose, and hydroxybutyl carboxymethyl cellulose. Alkali metal salts of these carboxyalkyl celluloses, particularly and preferably the sodium and potassium derivatives, are also be suitable.

Polyvinyl alcohol suitable for use in forming the shell is partially and fully hydrolyzed polyvinyl acetate, termed "polyvinyl alcohol" with polyvinyl acetate as hydrolyzed to an extent, also termed degree of hydrolysis, of from about 75 percent up to about 99 percent. Such materials are prepared by means of any of Examples I-XIV of U.S. Pat. No. 5,051,222.

In any of the embodiments described above, the average diameter of the plurality of microencapsulated flavourant particles may be between about 5 micrometres and about 500 micrometres, preferably between about 10 micrometres and about 100 micrometres.

In any of the embodiments described above, a segment of filter material in the mouthpiece may comprise between about 10 and about 500 microencapsulated flavourant particles, preferably between about 50 and about 300 microencapsulated flavourant particles, more preferably between about 100 and about 200 microencapsulated flavourant particles. One of skill in the art can determine and calibrate the number of microencapsulated flavourant particles used in an aerosol-generating article according to consumer preferences.

In any of the embodiments described above, the total weight of the microencapsulated flavourant particles within the aerosol-generating article may be between about 5 milligrams and about 50 milligrams, preferably between about 10 milligrams and about 30 milligrams, more preferably between about 20 milligrams and about 25 milligrams.

The plurality of microencapsulated flavourant particles are preferably formed using a spray drying process. A spray drying process typically involves spraying a liquid composition comprising a solvent and a solute or a suspension into a drying chamber, wherein the solvent is rapidly evaporated in the drying chamber to leave the solute or suspension in the form of microparticles. Forming the plurality of microencapsulated flavourant particles using a spray drying process may be a convenient and cost-effective process for forming the particles, particularly in those embodiments in which each microencapsulated flavourant particle comprises a flavourant contained within a shell. Spray drying processes suitable for forming the microencapsulated flavourant particles according to the present invention are known within the food industry, for example, and the skilled person can select a suitable spray drying process depending on the particular materials used to form the microencapsulated flavourant particles. Suitable spray dryers are commercially available from GEA Process Engineering A/S, Soeborg, Denmark.

Preferably, the breakable capsule is thermally stable at the temperatures of the aerosol (such as smoke) as the aerosol contacts the capsule in the mouthpiece. That is, the breakable capsule preferably does not release or leak the liquid due to exposure to the temperature of the aerosol. The temperature of the aerosol as it contacts the breakable capsule depends in part on the position of the capsule in the mouthpiece relative to the source of the aerosol that is generated in the aerosol generating article.

Preferably, the breakable capsule is thermally stable at temperatures up to about 70 degrees Celsius, preferably up to about 80 degrees Celsius, more preferably up to about 90 degrees Celsius.

In any of the embodiments described above, the breakable capsule preferably comprises the liquid contained within a breakable shell. Preferably, the material forming the breakable shell exhibits a greater hydrophobic effect than the liquid contained within the breakable shell. Preferably, the liquid is an aqueous liquid comprising water. The liquid may comprise more than about 50 percent water, more than about 75 percent water, or more than about 80 percent water, by weight.

The breakable shell can include one or more hydrocolloids, which can be, for example, gelatin or a vegetal ingredient. For example, the shell can include gelatin; a modified starch; a polysaccharide based material, such as pectin or alginate; gelatin; a paraffin wax; a polyvinyl alcohol; vinyl acetate; agar; algin; sorbitol; glycerol; arabic guar; carrageenan; a vegetable gum such as ghatti gum, pullulan gum, mannan gum; or any other suitable material or combinations thereof. Preferably, the shell contains an alginate.

The shell may contain any suitable amount of the one or more hydrocolloids, such as from about 1.5% w/w to about 95% w/w, preferably from about 4% w/w to about 75% w/w, and even more preferably from about 20% w/w to about 50% w/w of the total dry weight of the shell.

The shell may further include one or more fillers. As used herein a "filler" is any suitable material that can increase or decrease the percentage of dry material in the shell, or change the viscoelastic properties of the shell (such as a plasticizer). Increasing the dry material amount in a shell can result in solidifying the shell, and in making the shell physically more resistant to deformation. Preferably, the filler is selected from the group comprising starch derivatives such as dextrin, maltodextrin, cyclodextrin (alpha, beta or gamma), or cellulose derivatives such as hydroxypropylmethylcellulose (HPMC), hydroxypropylcellulose (HPC), methylcellulose (MC), carboxymethylcellulose (CMC), polyvinyl alcohol, polyols or mixture thereof. Dextrin is a preferred filler. The amount of filler in the shell is generally 98.5% or less, preferably from about 25% to about 95%, more preferably from about 40% to about 80%, and even more preferably from about 50% to about 60% by weight of the total dry weight of the shell.

The breakable shell may be of any suitable thickness. In some embodiments, the shell thickness is from about 10 microns to about 500 microns, preferably from about 20 microns to about 150 microns, more preferably from about 30 microns to about 80 microns.

The breakable capsule may have any suitable ratio of the weight of the breakable shell to the total weight of the breakable capsule. For example, the ratio of the weight of the shell to the total weight of the capsule can be from about 5% to about 15%, preferably from about 6% to about 10%, more preferably from about 8% by weight/total weight of the capsule.

The contents of the breakable capsule may represent any suitable weight percent of the capsule. For example, the contents of the breakable capsule may represent by weight from about 85% to about 95% of the capsule, preferably from about 90% to about 94% by weight, more preferably from about 92% by weight.

The breakable capsule may have any suitable total weight. The total weight of the capsule can be from about 5 mg to about 60 mg, preferably from about 10 mg to about 50 mg, more preferably from about 15 mg to about 40 mg.

In any of the embodiments described above, the breakable capsule may have any suitable shape. For example, the breakable capsule have a spherical shape. Alternatively, the breakable capsule may be one of a sphere, an ellipsoid, an ovoid, a polyhedron or a shape that approximates a sphere, an ellipsoid, an ovoid, or a polyhedron. Spherical, ellipsoidal, or ovoidal shapes have a substantially round cross-sectional shape.

Preferably, the breakable capsule has a substantially round cross-sectional shape, wherein the maximum diameter of the breakable capsule is between about 2.5 millimetres and about 5 millimetres. A breakable capsule having a maximum diameter within this range may advantageously be sufficiently small to be incorporated into an aerosol-generating article having dimensions that are similar to the dimensions of a conventional aerosol-generating article, such as a filter cigarette. A breakable capsule having a maximum diameter within this range may advantageously be large enough to contain sufficient liquid to facilitate release of the flavourant from substantially all of the microencapsulated flavourant particles when the breakable capsule is broken.

The breakable capsule is breakable upon the application of a breaking force to the breakable capsule. For example, the breakable capsule may be broken by applying a compressive force to the breakable capsule. The compressive force may be exerted in any direction, but is preferably exerted in a direction perpendicular to the longitudinal direction of the aerosol generating article. One preferable method of applying the compressive force would be for a user to squeeze or otherwise exert a compressive force on the breakable capsule or, where the breakable capsule is provided within the at least one segment of filter material, by squeezing or otherwise exerting a compressive force on the at least one segment of filter material containing the breakable capsule. The breakable capsule may be broken prior to or during the smoking of the aerosol generating article. The squeezing or compression action or application of external force preferably breaks the breakable capsule, which in turn, causes at least a portion of the liquid to be released into the at least one filter segment. Alternatively, the squeezing or compression action may provide a sustained release of liquid over a range of compression forces. The liquid may then activate the microencapsulated flavourant particles by causing the release of the flavourant upon contact of the liquid with the microencapsulate flavourant particles. An external device, such as a pinching device, a tube squeezing device, tweezers or any other device for applying compression forces, may also be used to concentrate the force at a prescribed location.

Preferably, the breakable capsule is a crushable capsule. As used herein, a crushable capsule is a capsule having a crush strength from about 0.01 kp to about 5 kp, preferably from about 0.5 kp to about 2.5 kp. The crush strength of the capsule can be measured by continuously applying a load vertically onto the capsule until rupture. The crush strength of the capsule can be measured by using a LLOYD-CHATILLON Digital Force Gauge, Model DFIS 50, having a capacity of 25 Kg, a resolution of 0.02 Kg, and an accuracy of +/−0.15%. The force gauge can be attached to a stand; the capsule can be positioned in the middle of a plate that is moved up with a manual thread screw device. Pressure can then be applied manually. The gauge records the maximum force applied at the very moment of the rupture of the capsule (measured in, for example, Kg or in Lb). Rupture of the capsule results in the release of the liquid.

Additional methods for characterising capsules include crush force which is the maximum compressive force measured in, for example, Newtons that a capsule can withstand before breakage; and distance at breakage which is the change in dimension of the capsule, that is, deformation, due to compression at breakage. It can also be expressed for example by the ratio between a dimension of the capsule (e.g., the capsule diameter) and the dimension of the capsule, measured in the direction of the compression force, when it is compressed to the point of breakage. The compression is generally applied toward the floor by the compression plates of an automatic or manual compression testing machine. Such machines are well known in the art and commercially available.

In preferred embodiments, the breakable capsule has a crush strength prior to introduction into an aerosol generating article of from about 0.6 kp to about 2 kp, preferably from about 0.8 kp to about 1.2 kp. The capsule preferably has a crush strength after introduction into an aerosol generating article and subjected to a smoking test from about 0.6 kp to about 2 kp, more preferably from about 0.8 kp to about 1.2 kp. Alternatively, the capsule has a crush force value prior to introduction into an aerosol generating article of about 5 N to about 20 N, preferably from about 7 N to about 18 N, and more preferably about 12.0 N. The compression test machine can operate at a range of speed from 10 mm/min to 420 mm/min. For capsules of diameter in the range of about 4 mm to about 7 mm diameter, the capsule prior to introduction into an aerosol generating article may exhibit a distance at breakage of about 0.60 mm to about 0.80 mm, preferably about 0.74 mm. The above crush force and distance at breakage is typically obtained when a universal tensile/compression testing machine equipped with 100 N tension load cell like, Instron or equivalent, is operating at about 30 mm/min and at 22° C. under 60% relative humidity. An example of a manual test machine is the Alluris Type FMI-220C2-Digital Force Gauge 0-200N-Supplier: Alluris GmbH & Co.

Preferably, the distance at breakage is in a range from about 0.5 mm to about 2 mm; more preferably from about 1 mm to about 1.5 mm; and even more preferably about 1.25 mm.

Various mouthpiece constructions may be used, in which one or more segments of filter material may be incorporated. Exemplary filter structures that may be used include, but are not limited to, a mono filter, a dual filter, a triple filter, a single or multi cavity filter, a recessed filter, a free-flow filter, and combinations thereof. Mono filters typically contain cellulose acetate tow or cellulose paper materials. Dual filters typically comprise a cellulose acetate mouth end and a pure cellulose or cellulose acetate segment. The length and pressure drop of the segments in a dual filter may be adjusted to provide optimal sorption, while maintaining acceptable resistance-to-draw. Cavity filters include at least two segments, for example, acetate-acetate, acetate-paper or paper-paper, separated by at least one cavity. Recessed filters include an open cavity at the mouth end. In any of the embodiments described above, at least part of the breakable capsule may be positioned within the at least one segment of filter material or a cavity.

The at least one segment of filter material may comprise a first segment of filter material in which the plurality of microencapsulated flavourant particles is dispersed. At least part of the breakable capsule may be positioned within the first segment of filter material. The breakable capsule may be positioned entirely within the first segment of filter material.

Alternatively, the at least one segment of filter material may further comprise a second segment of filter material, wherein at least a portion of the breakable capsule is positioned within the first segment of filter material. The breakable capsule may be positioned entirely within the second segment of filter material. To facilitate contact between the liquid and the plurality of microencapsulated flavourant particles when the breakable capsule is broken, the second segment of filter material is preferably positioned adjacent to the first segment of filter material.

The second segment of filter material may be positioned upstream of the first segment of filter material. Alternatively, the second segment of filter material may be positioned downstream of the first segment of filter material. As used herein, the terms "upstream" and "downstream" are used to describe the relative positions of elements, or portions of elements, of the aerosol generating article in relation to the direction in which a consumer draws on the aerosol generating article during use thereof. Aerosol-generating articles as described herein comprise a downstream end (that is, the mouth end) and an opposed upstream end. In use, a consumer draws on the downstream end of the aerosol-generating article. The downstream end is downstream of the upstream end, which may also be described as the distal end. The mouthpiece is downstream of the aerosol generating substrate.

In those embodiments in which the breakable capsule is positioned within a second segment of filter material, the second segment of filter material may comprise an opening in an end of the second segment of filter material adjacent to the first segment of filter material, the opening facilitating the direct transfer of the liquid from the breakable capsule to the first segment of filter material when the breakable capsule is broken.

Instead of providing the breakable capsule within a second segment of filter material, the breakable capsule may alternatively be provided separately from any segments of filter material within the mouthpiece. That is, the breakable capsule may form an entire mouthpiece segment that is provided between two segments of filter material, or provided between the first segment of filter material and the aerosol-generating substrate.

Additionally, or alternatively, the breakable capsule may be configured so that the breakable capsule breaks at a predetermined position on the surface of the breakable capsule when a breaking force is applied to the capsule. Configuring the breakable capsule to break at a predetermined position on the surface of the breakable capsule may provide a controlled and directed release of the liquid from the breakable capsule. Preferably, the predetermined position is provided on the portion of the surface of the breakable capsule closest to the first segment of filter material so that the liquid is directed into the first segment of filter material when the liquid is released from the breakable capsule.

In embodiments in which the breakable capsule is configured to break upon the application of a compressive force to the breakable capsule, the predetermined position on the surface of the breakable capsule may be formed by a frangible portion of the breakable capsule. For example, in those embodiments in which the breakable capsule comprises a breakable shell in which the liquid is contained, the frangible portion may be a weakened portion of the shell. The frangible portion may comprise a weakened portion of the shell, such as a portion of the shell comprising one or more grooves or scoring lines. Additionally, or alternatively, the weakened portion of the shell may have a reduced thickness compared to the remainder of the shell.

The mouthpiece may comprise a mouth end segment of filter material downstream of the first segment of filter material and, where present, the second segment of filter material. In this case, the mouth end segment of filter material is positioned at a downstream end of the aerosol-generating article. Providing a mouth end segment of filter material may advantageously restrict or prevent migration of the liquid from the breakable capsule to the downstream end of the aerosol-generating article when the breakable capsule is broken.

Additionally, or alternatively, the mouthpiece may comprise an upstream segment of filter material position upstream of the first segment of filter material and, where present, the second segment of filter material. In this case, the upstream segment of filter material is positioned adjacent to the aerosol-generating substrate. Providing an upstream segment of filter material may be particularly advantageous in embodiments in which the aerosol-generating substrate is heated during use of the aerosol-generating article, as the upstream segment may prevent excessive heating of at least one of the breakable capsule and the plurality of microencapsulated flavourant particles.

In any of the embodiments described above, the mouthpiece may comprise a mouthpiece wrapper wrapped around the breakable capsule and the at least one segment of filter material. The mouthpiece wrapper may be formed from a porous material, such as a porous paper. However, the mouthpiece wrapper is preferably formed from a non-porous material, such as a non-porous paper or a polymeric material, which may reduce or prevent migration of at least one of the liquid from the breakable capsule and the flavourant from the plurality of microencapsulated flavourant particles to the exterior of the aerosol-generating article. The non-porous material may comprise an inherently non-porous material, or the non-porous material may comprise a porous substrate onto which a non-porous coating or a hydrophobic substance is applied.

Preferably, the mouthpiece wrapper has a porosity of less than about 20 Coresta Units, more preferably less than about 10 Coresta Units, and more preferably less than about 5 Coresta Units, measured in accordance with the Coresta Recommended Method No. 40. Most preferably, the mouthpiece wrapper has a porosity of about zero Coresta Units. Suitable materials for forming the mouthpiece wrapper include cellulosic polymeric materials, starch-based polymeric materials, polyvinyl alcohol, cellophane, polylactide, and combinations thereof.

The mouthpiece wrapper may have a basis weight of less than about 90 grams per square metre, preferably less than about 60 grams per square metre, more preferably less than about 40 grams per square metre. The mouthpiece wrapper preferably has a basis weight of more than about 20 grams per square metre.

In any of the embodiments described above, each of the microencapsulated flavourant particles may contain a single flavourant, or a mixture of two or more different flavourants.

The plurality of microencapsulated flavourant particles may consist of substantially the same microencapsulated flavourant particles each containing the same flavourant or mixture of different flavourants.

The plurality of microencapsulated flavourant particles may comprise a mixture of different microencapsulated flavourant particles containing different flavourants or mixtures of flavourants. The mixture of different microencapsulated flavourant particles may comprise two or more different populations of microencapsulated flavourant particles, each population comprising a single flavourant or a mixture of two or more different flavourants. Providing a mixture of different microencapsulated flavourant particles may allow the ratio of different flavourants provided within the aerosol generating article to be adjusted during manufacture as desired for different products.

In any of the embodiments described above, the flavourant within each microencapsulated flavourant particle may comprise at least one of menthol, eugenol, or a combination of menthol and eugenol. Additionally, or alternatively, the flavourant may comprise anethole, linalool, or a combination thereof.

Many naturally occurring flavourants can be obtained either by extraction from a natural source or by chemical synthesis if the structure of the compound is known. The flavourants can be extracted from a part of a plant or an animal by physical means, by enzymes, or by water or an organic solvent, and thus include any extractive, essence, hydrolysate, distillate, or absolute thereof. Plants that can be used to provide flavourants include, but are not limited to, those belonging to the families, Lamiaceae (for example, mints), Apiaceae (for example, anise, fennel), Lauraceae (for example, laurels, cinnamon, rosewood), Rutaceae (for example, citrus fruits), Myrtaceae (for example, anise myrtle), and Fabaceae (for example, liquorice). Non-limiting examples of sources of flavourants include mints such as peppermint and spearmint, coffee, tea, cinnamon, clove, ginger, cocoa, vanilla, chocolate, eucalyptus, geranium, agave, juniper, lemon balm, basil, cinnamon, lemon basil, chive, coriander, lavender, sage, tea, thyme and caraway. The term "mints" is used to refer to plants of the genus *Mentha*. Suitable types of mint leaf may be taken from plant varieties including but not limited to *Mentha piperita, Mentha arvensis, Mentha niliaca, Mentha citrata, Mentha spicata, Mentha spicata crispa, Mentha cordifolia, Mentha longifolia, Mentha pulegium, Mentha suaveolens*, and *Mentha suaveolens* variegate.

As described above, the flavourant may be intended to deliver a gustatory sensation in addition to, or as an alternative to, a taste sensation. Such additional or alternative sensations include a cooling or a warming sensation, a tingling sensation, a numbing sensation, effervescence, increased salivation, and combinations thereof. These sensory effects may be provided by one or more flavourants also intended to deliver a taste sensation, including the flavourants listed above. Additionally, or alternatively, the flavourant may comprise at least one material which provides one or more of these sensory effects without providing a taste sensation. For example, suitable compounds that produce a cooling effect and can be used as an active material include, but are not limited to, the family of carboxamide compounds, such as the Wilkinson-Sword (WS) compounds WS-3 (N-Ethyl-p-menthane-3-carboxamide), WS-23 (2-Isopropyl-N,2,3-trimethylbutyramide), WS-5 [Ethyl 3-(p-menthane-3-carboxamido)acetate], WS-27 (N-Ethyl-2,2-diisopropylbutanamide), WS-14 [N-([ethoxycarbonyl]methyl)-p-menthane-3-carboxamide], and WS-116 (N-(1,1-Dimethyl-2-hydroxyethyl)-2,2-diethylbutanamide).

Flavourants that deliver a gustatory sensation without delivering an aroma sensation, such as cooling agents or heating agents (capsaicin, for example), are perceived by the consumer only through a physiological reaction with taste receptors on at least one of the lips and the tongue.

In any of the embodiments described above the aerosol-generating article may further comprise a tipping wrapper circumscribing at least a portion of each of the mouthpiece and the aerosol-generating substrate to secure the mouthpiece to the aerosol-generating substrate.

Aerosol generating-articles according to the present invention may be filter cigarettes or other smoking articles in which the aerosol-generating substrate comprises a tobacco material that is combusted to form smoke. Therefore, in any of the embodiments described above, the aerosol-generating substrate may comprise a tobacco rod.

Alternatively, aerosol generating-articles according to the present invention may be articles in which a tobacco material is heated to form an aerosol, rather than combusted. In one type of heated aerosol-generating article, a tobacco material is heated by one or more electrical heating elements to produce an aerosol. In another type of heated aerosol-generating article, an aerosol is produced by the transfer of heat from a combustible or chemical heat source to a physically separate tobacco material, which may be located within, around or downstream of the heat source. The present invention further encompasses aerosol-generating articles in which a nicotine-containing aerosol is generated from a tobacco material, tobacco extract, or other nicotine source, without combustion, and in some cases without heating, for example through a chemical reaction.

The present invention also extends to a method of manufacturing filter rods for use in forming mouthpieces of aerosol-generating articles according to the first aspect of the present invention, in accordance with any of the embodiments described above. Therefore, according to a second aspect of the present invention there is provided a method of forming a plurality of filter rods, the method comprising providing a plurality of microencapsulated flavourant particles, providing a filter material, and depositing the plurality of microencapsulated flavourant particles onto the filter material. The method further comprises forming the filter material into a substantially continuous filter rod, the substantially continuous filter rod comprising the plurality of microencapsulated flavourant particles dispersed within the filter material. The substantially continuous filter rod is cut at spaced apart intervals to form a plurality of filter rods, and at least one breakable capsule is inserted into each filter rod, each breakable capsule containing a liquid, wherein the plurality of microencapsulated flavourant particles are adapted to release the flavourant upon contact with the liquid within the breakable capsule.

In any of the embodiments described above, the plurality of microencapsulated flavourant particles are preferably spray dried microencapsulated flavourant particles. Therefore, the step of providing a plurality of microencapsulated flavourant particles may comprise forming the plurality of microencapsulated flavourant particles using a spray drying process. Using a spray drying process to form the plurality of microencapsulated flavourant particles may be a convenient and cost-effective process for forming the particles, particularly in those embodiments in which each microencapsulated flavourant particle comprises a flavourant contained within a shell.

The invention will now be further described, by way of example only, with reference to the accompanying drawings in which FIG. 1 shows a longitudinal cross-sectional view of an aerosol-generating article 10 according to an embodiment of the present invention. The aerosol-generating article 10 is a filter cigarette comprising an aerosol-generating substrate 12 in the form of a wrapped tobacco rod, and a mouthpiece 14. The mouthpiece 14 is secured to the wrapped tobacco rod by a tipping wrapper 16.

The mouthpiece 14 comprises an upstream filter segment 18 at an upstream end of the mouthpiece 14, a mouth end filter segment 20 at a downstream end of the mouthpiece 14, and an intermediate filter segment 22 positioned between the upstream filter segment 18 and the mouth end filter segment 20. A combining plug wrap 24 is wrapped around the filter segments 18, 20, 22 to combine them and form the mouthpiece 14.

The mouthpiece 14 further comprises a breakable capsule 26 received within a recess 28 in the upstream filter segment 18. The breakable capsule 26 comprises a breakable shell 30 defining a cavity in which a liquid 32 is received. During use of the aerosol-generating article 10, a consumer may squeeze the breakable capsule 26 to break the breakable shell 30, which releases the liquid 32 into the intermediate filter segment 22. The recess 28 in the upstream filter segment 18 is open at its downstream end to facilitate the release of the liquid 32 into the intermediate filter segment 22. An indicia may be provided on an outer surface of the tipping wrapper 16 to indicate the portion of the aerosol-generating article 10 which should be squeezed to break the breakable capsule 26.

The mouthpiece 14 further comprises a plurality of microencapsulated flavourant particles 38 dispersed within the intermediate filter segment 22. The plurality of microencapsulated flavourant particles 38 each comprise a flavourant received within a shell, wherein the shell is formed from a material that dissolves or otherwise breaks down upon contact with the liquid 32 within the breakable capsule 26. Therefore, during use of the aerosol-generating article 10, a consumer may squeeze the breakable capsule 26 to break the breakable shell 30 at the frangible portion 34, which releases the liquid 32 into the intermediate filter segment 22 and causes the release of the flavourant from the plurality of microencapsulated flavourant particles 38.

The invention claimed is:

1. An aerosol-generating article configured to be smoked by a user comprising:

an aerosol-generating substrate;

a mouthpiece comprising at least one segment of filter material;

a breakable capsule containing an aqueous liquid; and a plurality of microencapsulated flavourant particles dispersed within the at least one segment of filter material, wherein each of the microencapsulated flavourant particles comprises a flavourant encapsulated within a shell comprising a water sensitive material, such that the plurality of microencapsulated flavourant particles are adapted to release the flavourant upon contact with the aqueous liquid contained within the breakable capsule such that an unflavoured smoking experience is provided during smoking when the breakable capsule is unbroken and a flavoured smoking experience is provided during smoking when the breakable capsule is broken.

2. An aerosol-generating article according to claim 1, wherein each of the microencapsulated flavourant particles comprises an inner core of the flavourant contained within an outer shell comprising the water sensitive material.

3. An aerosol-generating article according to claim 1, wherein each of the microencapsulated flavourant particles comprises the flavourant dispersed within a shell matrix comprising the water sensitive shell material.

4. An aerosol-generating article according to claim 1, wherein the shell of each microencapsulated flavourant particle comprises at least one of polyvinyl alcohol, gelatin, one or more carrageenans, agar, gellan gum, one or more pectins, arabic gum, ghatti gum, pullulan gum, mannan gum, one or more modified starches, one or more alginate salts, hydrolyzed polyvinyl acetate about 75 percent to 90 percent hydrolyzed, hydroxyalkyl celluloses, carboxyalkyl celluloses, and combinations thereof.

5. An aerosol-generating article according to claim 1, wherein the breakable capsule comprises the aqueous liquid contained within a breakable shell, and wherein the breakable shell comprises at least one hydrocolloid.

6. An aerosol-generating article according to claim 1, wherein the breakable capsule has a substantially round cross-sectional shape, and wherein the maximum diameter of the breakable capsule is between 2.5 millimetres and 5 millimetres.

7. An aerosol-generating article according to claim 1, wherein the average diameter of the plurality of microencapsulated flavourant particles is between 5 micrometres and 500 micrometres.

8. An aerosol-generating article according to claim 1, wherein the total number of microencapsulated flavourant particles within the at least one segment of filter material is between 10 and 500 microencapsulated flavourant particles.

9. An aerosol-generating article according to claim 1, wherein the flavourant within at least some of the microencapsulated flavourant particles comprises a mixture of at least two different flavourants.

10. An aerosol-generating article according to claim 1, wherein the flavourant comprises menthol.

11. An aerosol-generating article according to claim 1, wherein the plurality of microencapsulated flavourant particles comprises a mixture of at least a first population of microencapsulated flavourant particles and a second population of microencapsulated flavourant particles, wherein the first population of microencapsulated flavourant particles comprises at least a first flavourant and wherein the second population of microencapsulated flavourant particles comprises at least a second flavourant, wherein the first flavourant is different to the second flavourant.

12. An aerosol-generating article according to claim 11, wherein the first and second populations of microencapsulated flavourant particles are provided within the same segment of filter material.

13. An aerosol-generating article according to claim 1, wherein at least part of the breakable capsule is positioned within the at least one segment of filter material.

14. An aerosol-generating article according to claim 1, wherein the plurality of microencapsulated flavourant particles are formed using a spray drying process.

15. A method of forming a plurality of filter rods for an aerosol-generating article, the method comprising:

providing a plurality of microencapsulated flavourant particles comprising a flavourant encapsulated within a shell comprising a water sensitive material;

providing a filter material;

depositing the plurality of microencapsulated flavourant particles onto the filter material;

forming the filter material into a substantially continuous filter rod, the substantially continuous filter rod comprising the plurality of microencapsulated flavourant particles dispersed within the filter material;

cutting the substantially continuous filter rod at spaced apart intervals to form a plurality of filter rods; and inserting at least one breakable capsule into each filter rod, each breakable capsule containing an aqueous liquid, wherein the plurality of microencapsulated flavourant particles are adapted to release the flavourant upon contact with the aqueous liquid within the breakable capsule such that an unflavoured smoking experience is provided during smoking when the breakable capsule is unbroken and a flavoured smoking experience is provided during smoking when the breakable capsule is broken.

16. A method according to claim 15, wherein the providing a plurality of microencapsulated flavourant particles comprises forming the plurality of microencapsulated flavourant particles using a spray drying process.

* * * * *